US011794083B1

(12) United States Patent
Nalla

(10) Patent No.: US 11,794,083 B1
(45) Date of Patent: Oct. 24, 2023

(54) PORTABLE MAGNETIC MULTIFUNCTION GOLF ACCESSORY

(71) Applicant: Anand Nalla, Irvine, CA (US)

(72) Inventor: Anand Nalla, Irvine, CA (US)

(73) Assignee: XYLOTECH SYSTEMS INC, Irvine, CA (US)

( * ) Notice: Subject to any disclaimer, the term of this patent is extended or adjusted under 35 U.S.C. 154(b) by 0 days.

(21) Appl. No.: 18/076,065

(22) Filed: Dec. 6, 2022

(51) Int. Cl.
*A63B 57/60* (2015.01)
*A63B 57/50* (2015.01)
*A63B 57/35* (2015.01)
*A63B 57/30* (2015.01)

(52) U.S. Cl.
CPC ..... *A63B 57/60* (2015.10); *A63B 57/35* (2015.10); *A63B 57/353* (2015.10); *A63B 57/50* (2015.10)

(58) Field of Classification Search
CPC ..... A63B 57/60; A63B 57/35; A63B 57/353; A63B 57/50
See application file for complete search history.

(56) References Cited

U.S. PATENT DOCUMENTS

D190,333 S 5/1961 Gunderson
3,763,515 A * 10/1973 Voss ..... A63B 57/50 15/236.08
D247,452 S * 3/1978 Kitay ..... D10/70
4,386,774 A * 6/1983 Buckman ..... A63B 57/00 473/406
4,535,987 A * 8/1985 Dikoff ..... A63B 57/60 273/DIG. 26
4,960,239 A * 10/1990 Wait ..... A63B 57/50 473/406
4,984,790 A * 1/1991 Dowdy ..... A63B 57/50 473/408
5,226,647 A * 7/1993 Notarmuzi ..... A63B 57/50 473/285
5,295,683 A 3/1994 Tate
5,305,999 A * 4/1994 Tate ..... A63B 57/353 224/269
D347,255 S 5/1994 Kerr et al.
D348,500 S 7/1994 Mortenson et al.
5,356,133 A * 10/1994 Bellagamba ..... A63B 57/207 473/406
D353,645 S 12/1994 Robidoux et al.
5,393,052 A * 2/1995 Kennedy ..... A63B 57/00 473/285
5,401,019 A * 3/1995 Wissman ..... A63B 57/50 473/286

(Continued)

FOREIGN PATENT DOCUMENTS

GB 2472881 A * 2/2011 ..... A63B 57/207

OTHER PUBLICATIONS

Merriam-Webster, "Definition of Bore", <merriam-webster.com/dictionary/bore>, retrieved on May 23, 2023. (Year: 2023).*

*Primary Examiner* — Steven B Wong
(74) *Attorney, Agent, or Firm* — The Roy Gross Law Firm, LLC; Roy Gross

(57) ABSTRACT

Relates to a portable magnetic multifunction golf accessory including the capability to be used for cleaning out golf club "head-groves" and the like, the capability to fix pitch marks and golf greens on a green, the capability of being used as a ball marker including a marker alignment aid, and the capability to be used as a club rest

12 Claims, 14 Drawing Sheets

(56) References Cited

U.S. PATENT DOCUMENTS 5,529,299 A * 6/1996 Bellagamba ..... A63B 57/00 473/285
D399,597 S * 10/1998 Craven ..... D21/789
D401,379 S * 11/1998 Goldoftas ..... D21/793
6,030,298 A 2/2000 Tate
6,050,905 A 4/2000 Tate
D438,587 S 3/2001 Schmitt, Jr.
D462,408 S 9/2002 Kerr
D489,111 S 4/2004 Perez et al.
6,733,402 B2 5/2004 Christensen
D534,982 S * 1/2007 Miller ..... A63B 57/207 D21/793
D571,428 S 6/2008 Williams
D583,893 S * 12/2008 Ruff ..... D21/794
7,494,431 B2 2/2009 Wang
7,850,550 B2 12/2010 Nania et al.
7,942,756 B1 * 5/2011 Neu ..... A63B 57/50 473/282
D653,722 S 2/2012 Morris, Jr. et al.
8,231,483 B2 * 7/2012 Gill ..... A63B 57/353 473/408
8,342,986 B2 1/2013 Rourke
D683,413 S 5/2013 Revert
8,454,457 B1 6/2013 Woods et al.
D695,864 S * 12/2013 Warfield ..... D21/793
D698,884 S 2/2014 Otsubo
D700,672 S 3/2014 Riley
D736,334 S * 8/2015 Perry ..... D21/793
D774,153 S 12/2016 Zwart
D790,019 S 6/2017 Jimenez
9,669,276 B1 * 6/2017 Maloy ..... A63B 57/353
D828,886 S * 9/2018 Fallon ..... D21/793
D834,124 S * 11/2018 Zwart ..... D21/793
D837,325 S 1/2019 Dardenne
D859,556 S * 9/2019 Kumpis ..... D21/794
D888,861 S 6/2020 Tueller
D888,862 S 6/2020 Tueller
D942,573 S 2/2022 Page
D965,720 S 10/2022 Buckley
2003/0148830 A1 * 8/2003 Hsiao ..... A63B 57/10 473/387
2004/0142773 A1 7/2004 Kennedy
2004/0248674 A1 * 12/2004 Bauley ..... A63B 57/353 473/406
2005/0037873 A1 2/2005 Kennedy
2006/0178234 A1 * 8/2006 Johnson ..... A63B 57/353 473/408
2009/0305818 A1 * 12/2009 Cameron ..... A63B 57/353 473/406
2010/0113175 A1 * 5/2010 Gill ..... A63B 57/357 473/285
2011/0201456 A1 * 8/2011 Schaaf ..... A63B 57/50 473/408
2012/0135817 A1 * 5/2012 Paustenbach ..... A63B 55/10 473/409
2013/0095958 A1 * 4/2013 Solheim ..... A63B 57/353 29/527.1
2017/0136324 A1 * 5/2017 Simpson ..... A63B 47/00
2022/0233927 A1 * 7/2022 Galacz ..... A63B 57/203
2022/0409968 A1 * 12/2022 Goserud ..... A63B 57/207

* cited by examiner

PORTABLE MAGNETIC MULTIFUNCTION GOLF ACCESSORY

FIELD OF THE INVENTION

The instant invention relates to a portable magnetic multifunction golf accessory including the capability to be used for cleaning out golf club "head-groves" and the like, the capability to fix pitch marks and divots on a green, the capability of being used as a ball marker including a marker alignment aid, and the capability to be used as a club rest.

BACKGROUND OF THE INVENTION

Golf is a game that is enjoyed by millions of people around the world. Since each course must accommodate a large number of players and observants, common courtesy and proper golf etiquette dictate that each golfer take steps to maintain the course in proper playing condition. For example, ball marks left when a ball strikes a green should be repaired so that the ball mark does not interfere with subsequent play. In addition to the foregoing, a ball on a green that is in the lie of another player's ball should be marked and removed from the green so that a clear approach to the hole is provided. Further, since golf is an outdoor game, mud and debris tend to accumulate on the golfer's shoes and clubs, thereby potentially adversely affecting the golfer's game play.

Such known systems and methods include: U.S. Pat. Nos. 4,627,621; 5,022,650; 5,295,683; 6,030,298; 6,050,905; 7,766,769; 7,850,550; 8,162,778; 8,231,483; 10,596,430; and 11,278,779.

While the golf tools disclosed in the foregoing patents may be effective to assist a golfer during play, it has been found that their usefulness is somewhat limited due to the failure to provide much-needed features in a compact size which can easily be carried by a golfer during play and/or easily stored and retrieved during play.

However, the prior art consists of familiar, expected, and obvious structural configurations, notwithstanding the myriad of designs encompassed by the crowded prior art that has developed for the fulfillment of countless objectives and requirements.

There exists a need in the art for an improved multipurpose/multifunctional golf accessory that may be used to assist a golfer in accomplishing a wide variety of tasks. In these respects, the present invention substantially departs from the conventional concepts and designs of the prior art, and in doing so provides an accessory primarily developed for the purpose of providing a multipurpose golf accessory that overcomes the limitations and disadvantages present in the prior art.

SUMMARY OF THE INVENTION

An object of the present invention is to provide a five-in-one divot tool that provides the following advantages:

Fix Pitch Marks on the Green

Slide out Ball Marker

Ball Marker Alignment Aid

Clean the club grooves

Club Rest

Another object of the invention is provide a divot tool that is handheld.

Another object of the invention is to provide a divot tool that is magnetic and comes apart.

Another object of the invention is to provide a divot tool that fixes divots using two prongs.

Another object of the invention is to provide a divot tool that also serves as a ball marker.

Another object of the invention is to provide a divot tool that also serves as a club rest.

Another object of the invention is to provide a divot tool that also serves as a club groove cleaner.

Another object of the invention is to provide a divot tool that also serves as an alignment aid.

Another object of the invention is to provide a divot tool that has arrows that help as an alignment aid.

These and other objects of the invention are achieved by providing a portable magnetic multifunctional golf accessory comprising: a golf green repairer, a club face grove cleaner, an object rest, a first ball marker, and a detachable second ball marker; including a housing with an upper face, a lower face, a proximal end, and a distal end the distal end of the housing forming the golf green repairer and the opposing proximal end the housing forming the object rest and first ball marker; wherein the golf green repairer comprising a plurality of tapered prongs such that sharper points are formed at a distal end of the plurality of tapered prongs to facilitate golf green repair; wherein the plurality of tapered prongs distal ends are configured to be used to clean out the groves of a golf club head; wherein the housing upper face includes a cavity disposed therein in which a detachable second ball marker is stored and detachably secured within the housing cavity via a magnet integrated into the housing and below the housing cavity; wherein the housing is adapted to be placed lower face down on a golf green and function as a ball marker via a semi-circular cut-out at the proximal end of the housing being abutted against a ball to be marked; wherein the housing is adapted to be anchored in the ground via the plurality of tapered prongs and when disposed in an upright position with the proximal end of the housing upward such that the semi-circular cut-out at the proximal end of the housing functions as an object rest; whereby an object may be placed and rest within the semi-circular cut-out at the upwardly pointed proximal end of the housing such that the object is propped off the ground and a tendency for the object to roll away because of unlevel ground placement of the housing is inhibited.

In certain embodiments, the housing comprises a natural material.

In certain embodiments, the housing comprises a synthetic material.

In certain embodiments, the housing comprises a metal.

In certain embodiments, the housing comprises a plastic or polymer.

In certain embodiments, the housing comprises a non-magnetic flux density field conductive material.

In certain embodiments, the housing includes indica to aide in ball replacement and alignment.

In certain embodiments, the detachable second ball marker comprises a magnetic flux density field conductive material.

In certain embodiments, the detachable second ball marker includes indica to aide in ball replacement and alignment.

In certain embodiments, the detachable second ball marker comprises a magnetic flux density field conductive material.

In certain embodiments, the detachable second ball marker comprises a magnetic flux density field conductive material.

In certain embodiments, the magnet is a permanent magnet configured as a disc with each flat side being an opposite magnetic polarity.

In certain embodiments, the magnet is encased in a protective barrier to mitigate physical and electromagnetic deterioration.

In certain embodiments, the magnet is of sufficient magnetic flux field density to detachably affix the golf accessory to a magnetic flux field conductive surface.

These and other objects of the invention are achieved by providing a method to perform golf play related tasks comprising the steps of: providing a magnetic multifunctional golf accessory comprising a golf green repairer, a club face grove cleaner, an object rest, a first ball marker, and a detachable second ball marker, the golf accessory including; a housing with an upper face, a lower face, a proximal end, and a distal end the distal end of the housing forming the golf green repairer and the opposing proximal end the housing forming the object rest and first ball marker; wherein the golf green repairer comprising a plurality of tapered prongs such that sharper points are formed at a distal end of the plurality of tapered prongs to facilitate golf green repair; wherein the plurality of tapered prongs distal ends are configured to be used to clean out the groves of a golf club head; wherein the housing upper face includes a cavity disposed therein in which a detachable second ball marker is stored and detachably secured within the housing cavity via a magnet integrated into the housing and below the housing cavity; wherein the housing is adapted to be placed lower face down on a golf green and function as a ball marker via a semi-circular cut-out at the proximal end of the housing being abutted against a ball to be marked; wherein the housing is adapted to be anchored in the ground via the plurality of tapered prongs and when disposed in an upright position with the proximal end of the housing upward such that the semi-circular cut-out at the proximal end of the housing functions as an object rest; whereby an object may be placed and rest within the semi-circular cut-out at the upwardly pointed proximal end of the housing such that the object is propped off the ground and a tendency for the object to roll away because of unlevel ground placement of the housing is inhibited.

It is contemplated in an embodiment of the invention that the magnet is encased in a housing which greatly slows and/or prevents the physical and electromagnetic deterioration of the magnet from air, water, chemicals, and the like during use and storage.

It is contemplated in an embodiment of the invention that the magnet is encased which greatly facilitates the integration of the magnet securely into the housing.

It is contemplated in an embodiment of the invention that the magnet is encased in a housing which greatly facilitates the permanent integration of the magnet securely into the housing via friction press fit, adhesive, or other means to secure a magnet into the inventive housing.

It is contemplated in an embodiment of the invention that the magnet is encased in a housing which facilitates the securing when not in use of a (second) ball marker, and the removal of the (second) ball marker.

Other objects of the invention and its particular features and advantages will become more apparent from consideration of the following drawings and accompanying detailed description. It should be understood that the detailed description and specific examples, while indicating the preferred embodiment of the invention, are intended for purposes of illustration only and are not intended to limit the scope of the invention.

DETAILED DESCRIPTION OF THE INVENTION

Figure 1:
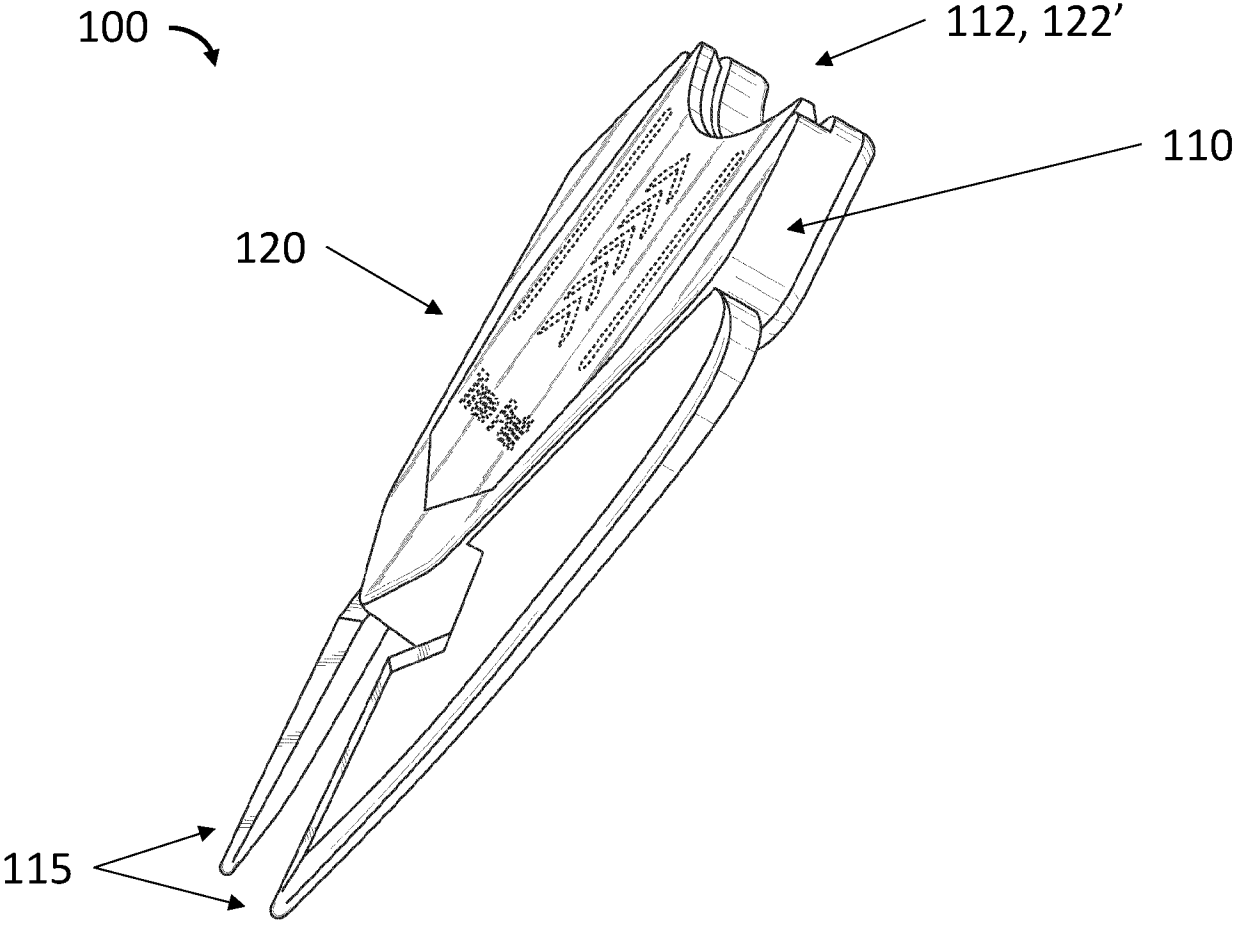
FIG. 1 depicts a perspective view of a preferred embodiments of the invention.
Figure 2:
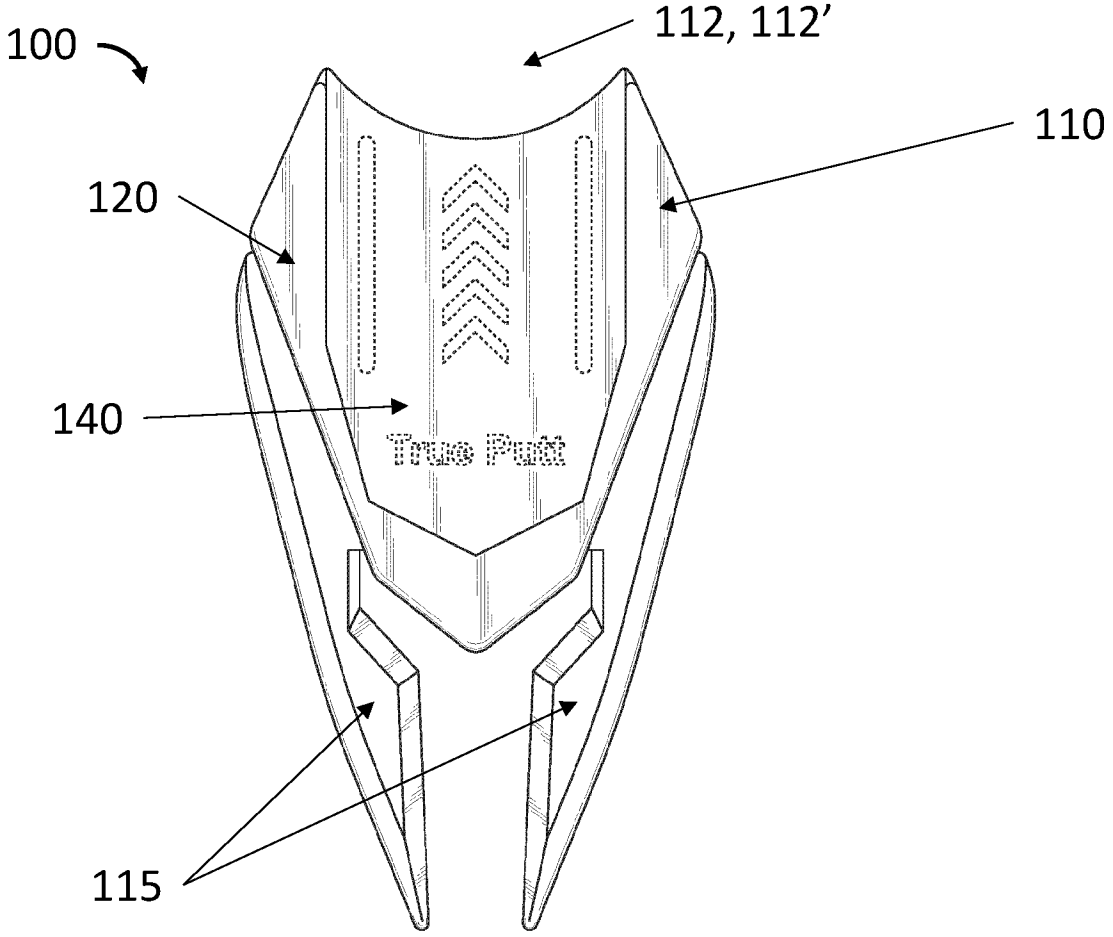
FIG. 2 depicts a top view of a preferred embodiments of the invention.
Figure 3:
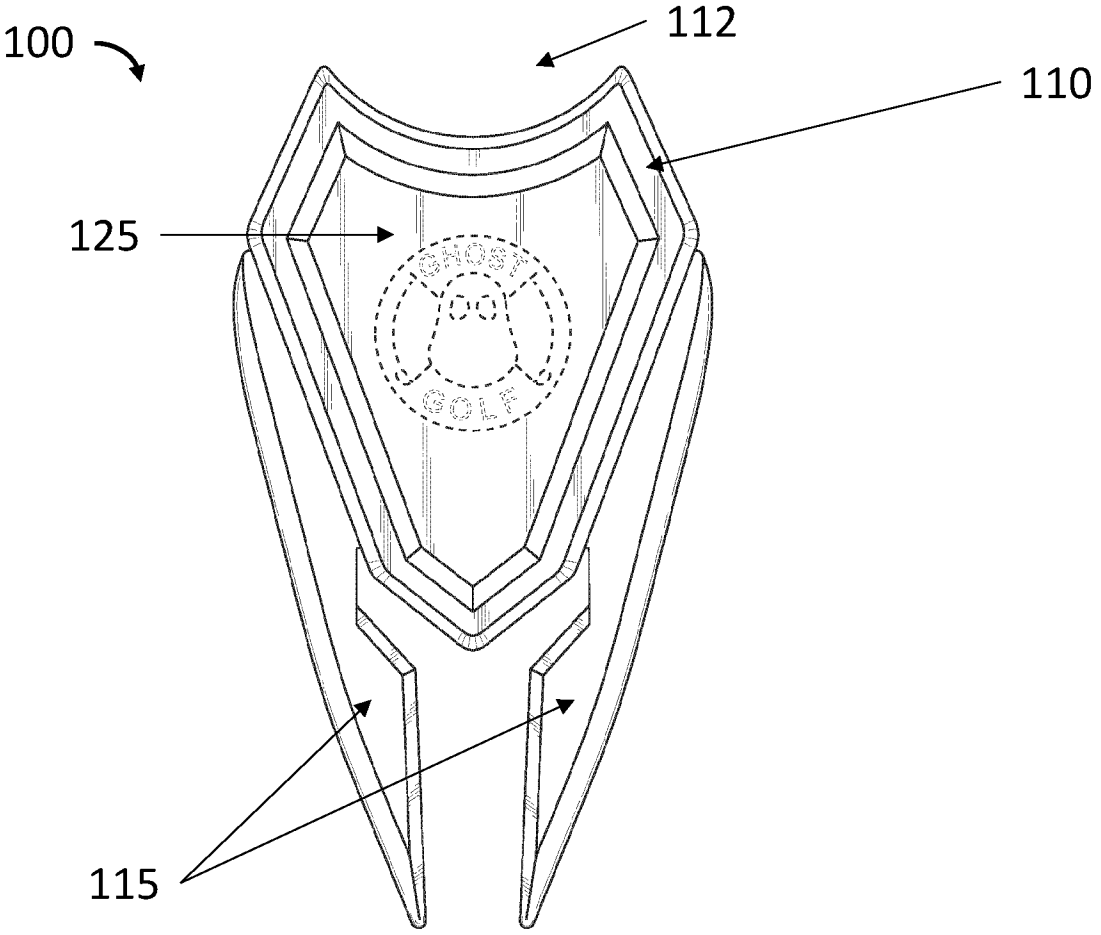
FIG. 3 depicts a bottom view of a preferred embodiments of the invention.
Figure 4:
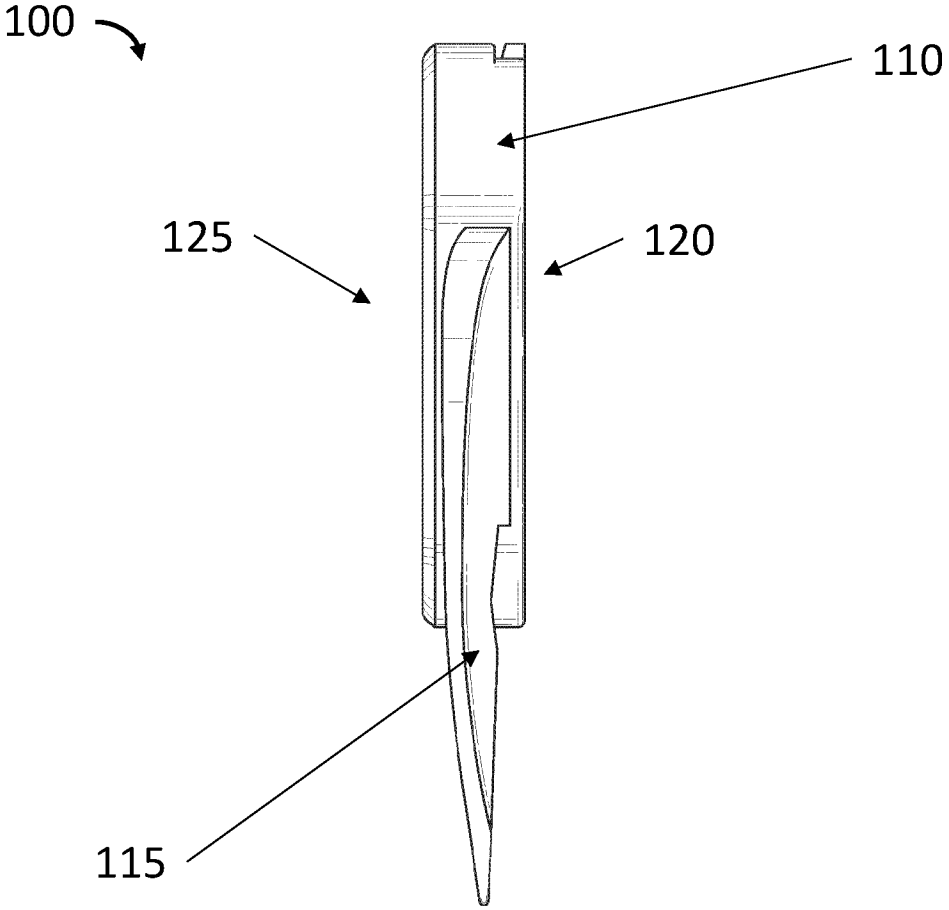
FIG. 4 depicts a side view of a preferred embodiments of the invention.
Figure 5:
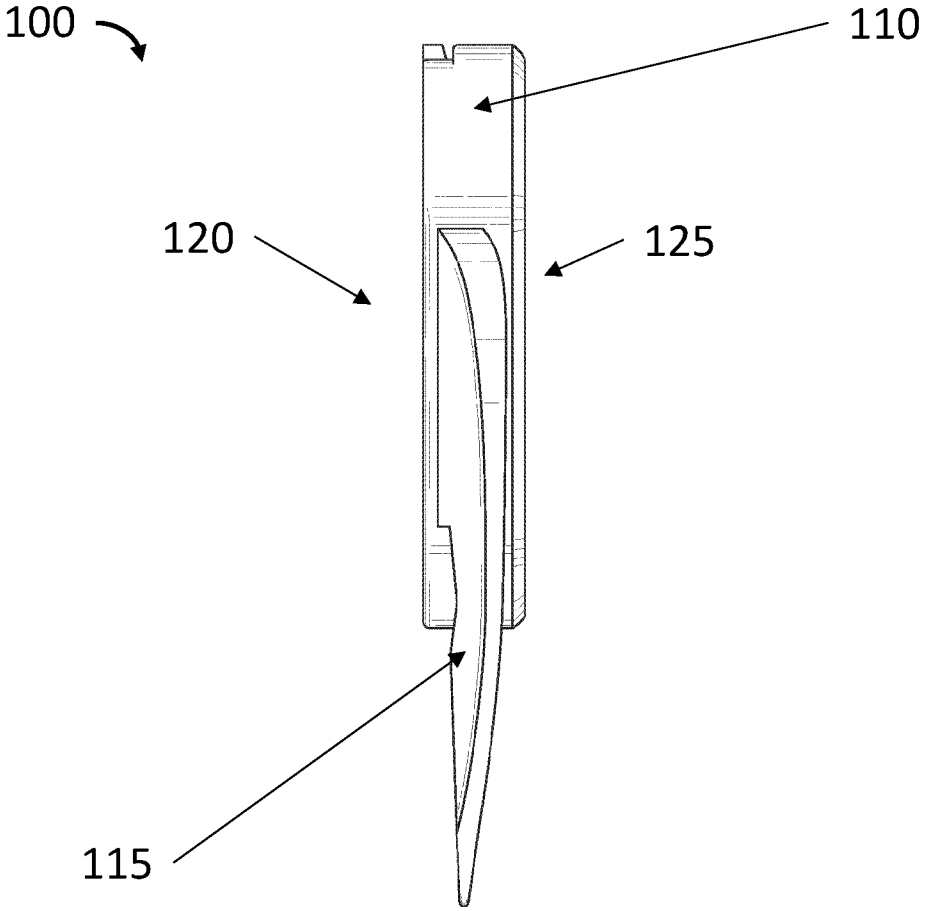
FIG. 5 depicts a side view of a preferred embodiments of the invention.
Figure 6:
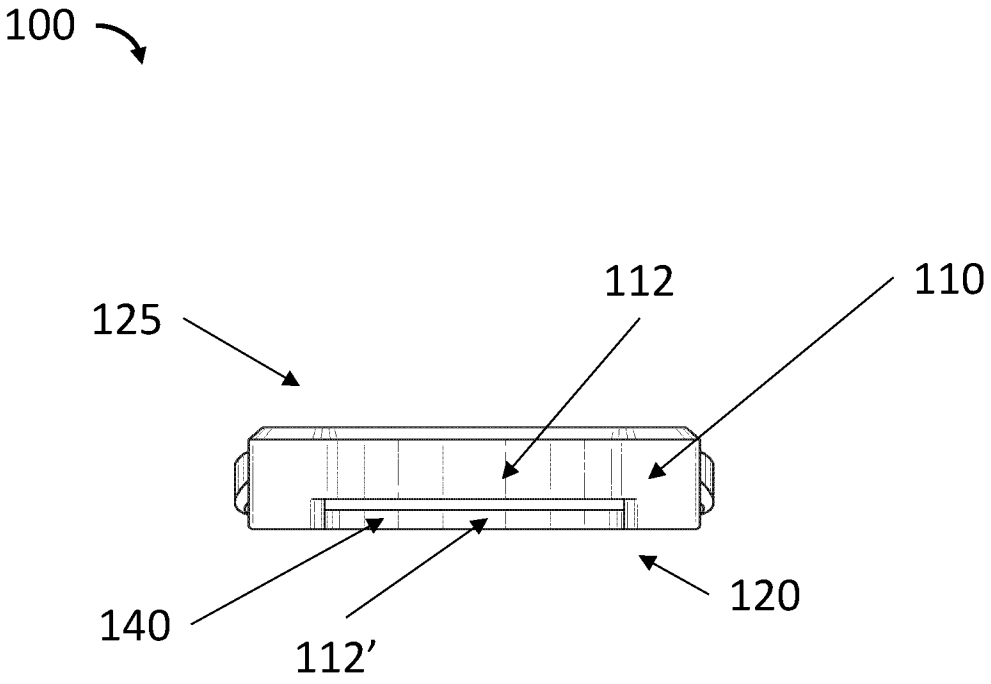
FIG. 6 depicts a proximal end view of a preferred embodiments of the invention.
Figure 7:
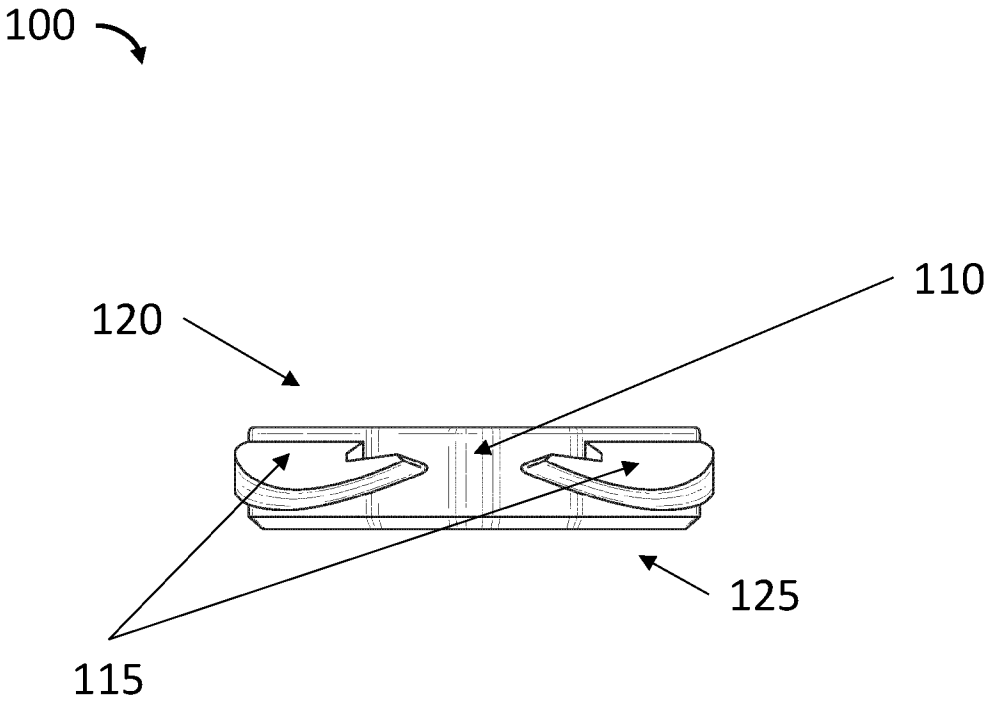
FIG. 7 depicts a distal end view of a preferred embodiments of the invention.
Figure 8:
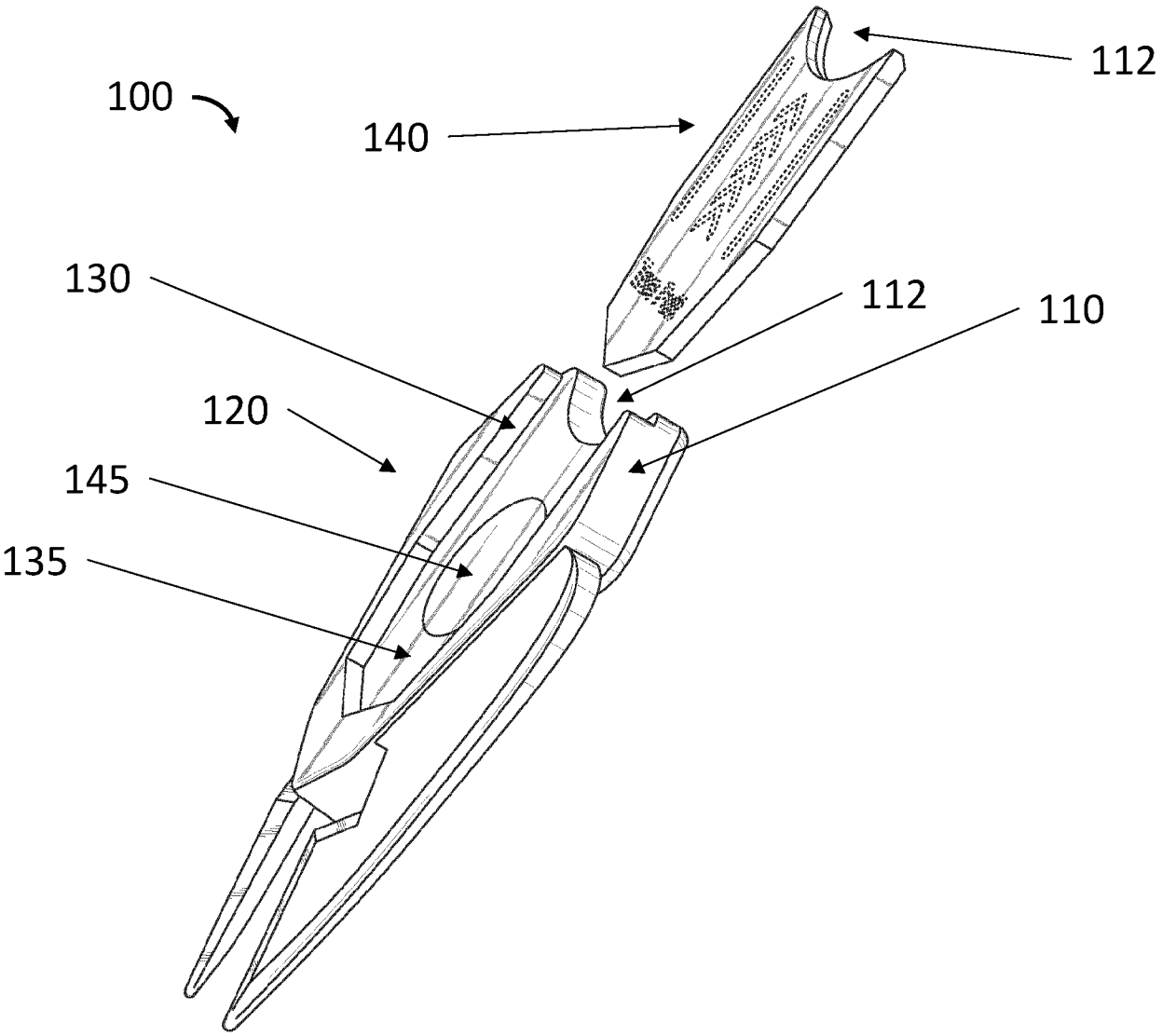
FIG. 8 depicts a second perspective view of a preferred embodiments of the invention.
Figure 9:
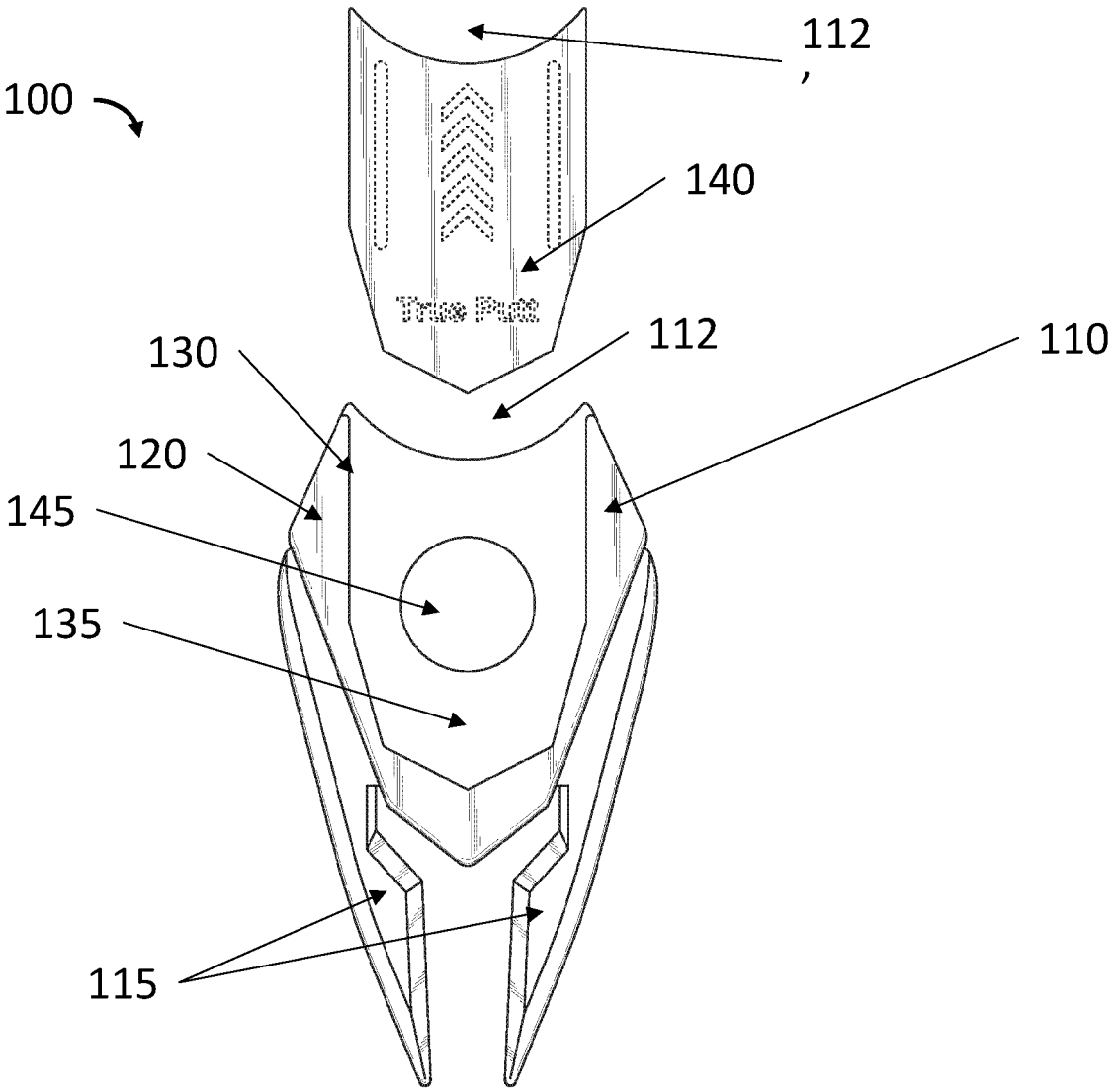
FIG. 9 depicts a second top view of a preferred embodiments of the invention.
Figure 10:
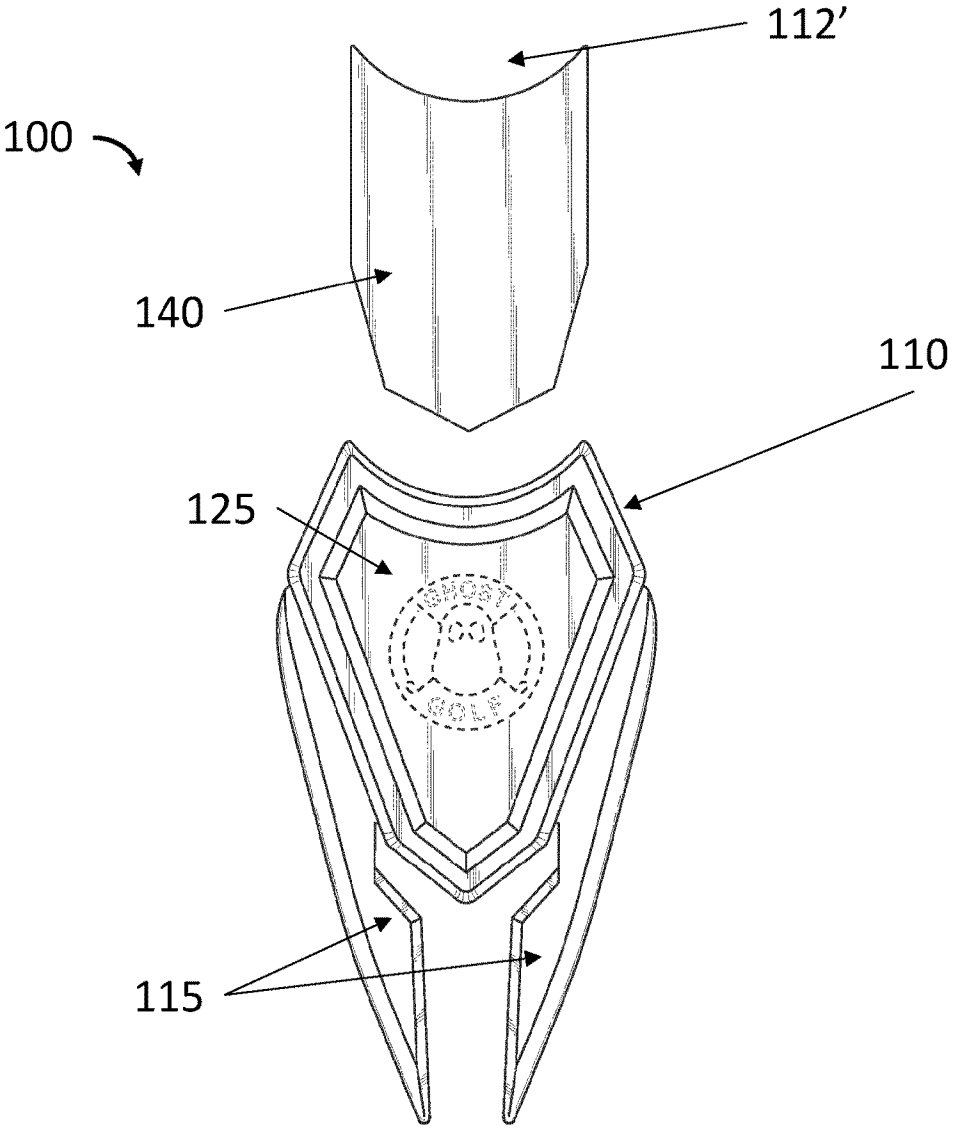
FIG. 10 depicts a second bottom view of a preferred embodiments of the invention.
Figure 11:
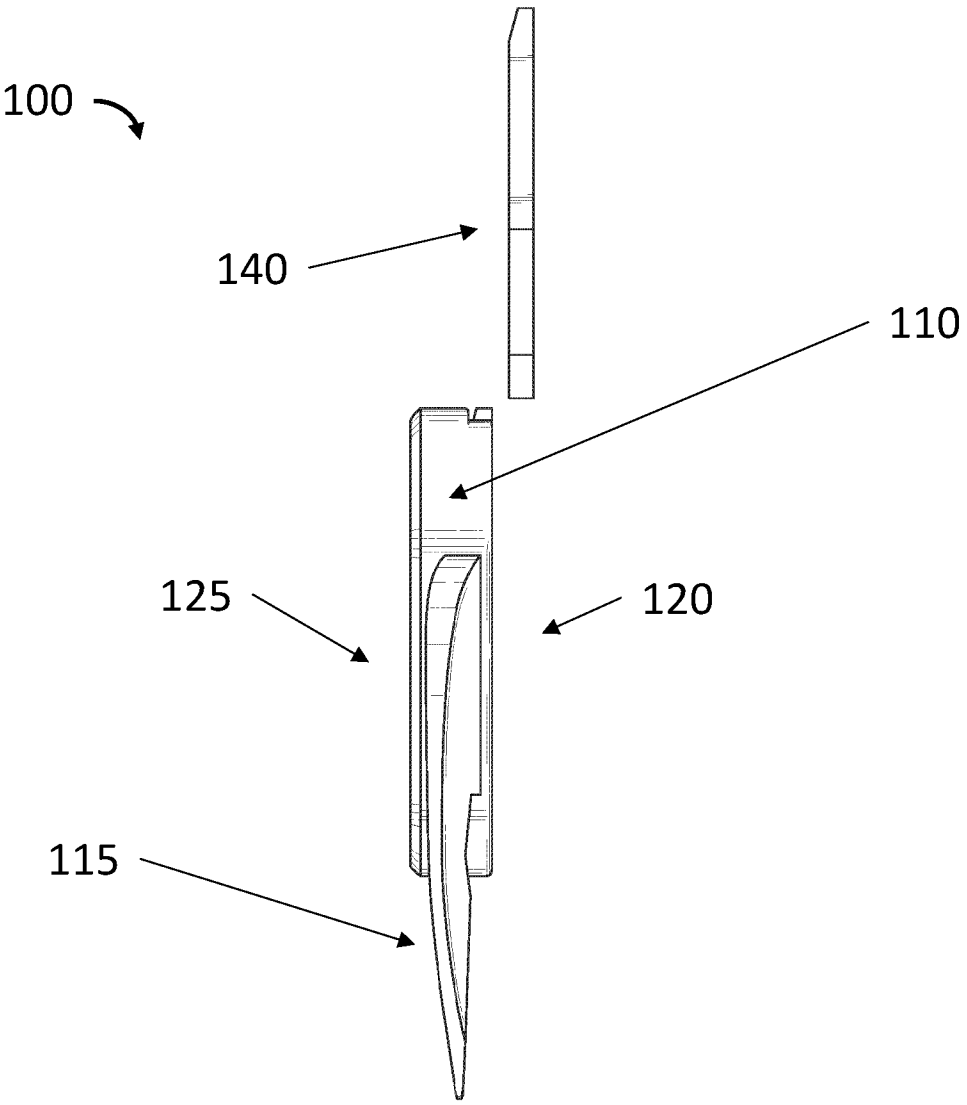
FIG. 11 depicts a second side view of a preferred embodiments of the invention.
Figure 12:
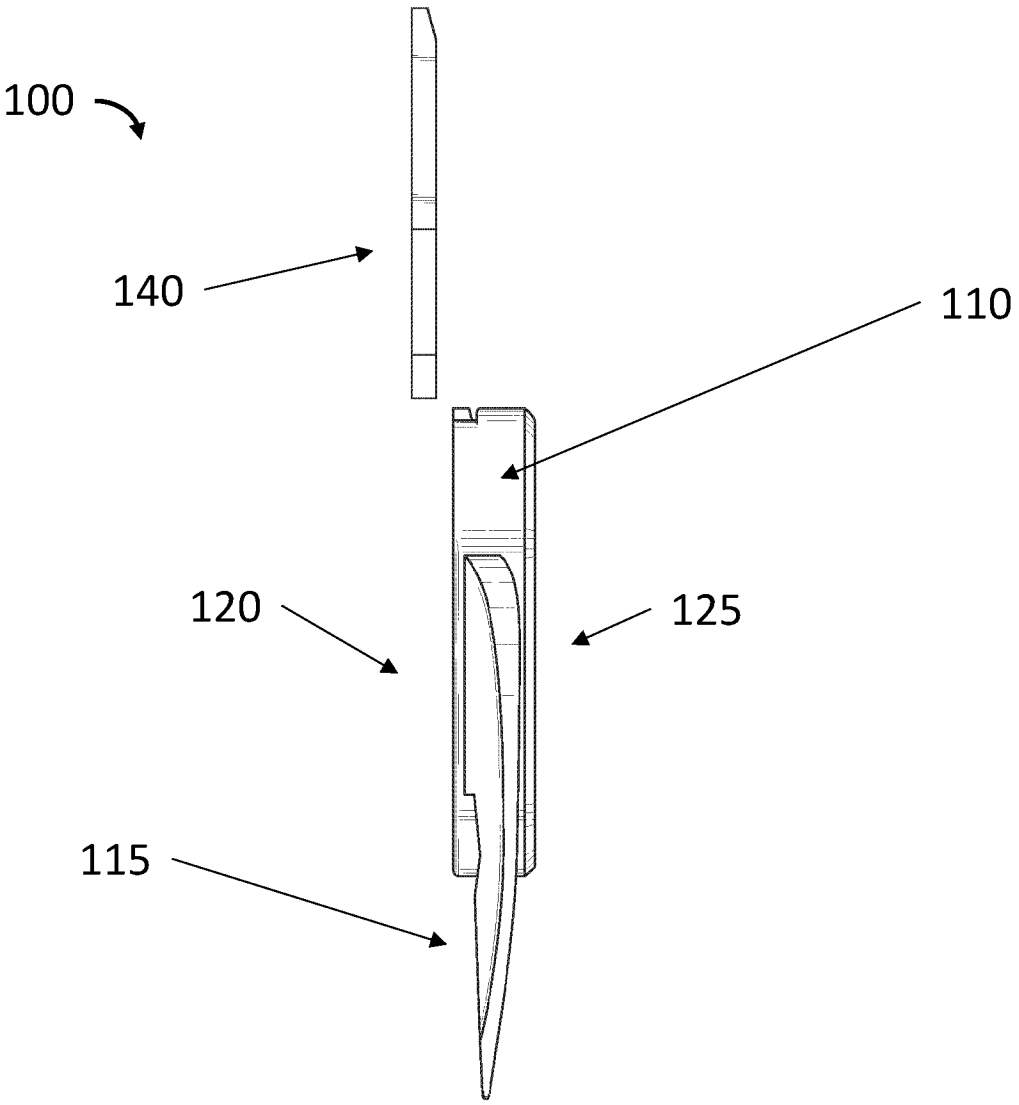
FIG. 12 depicts a second side view of a preferred embodiments of the invention.
Figure 13:
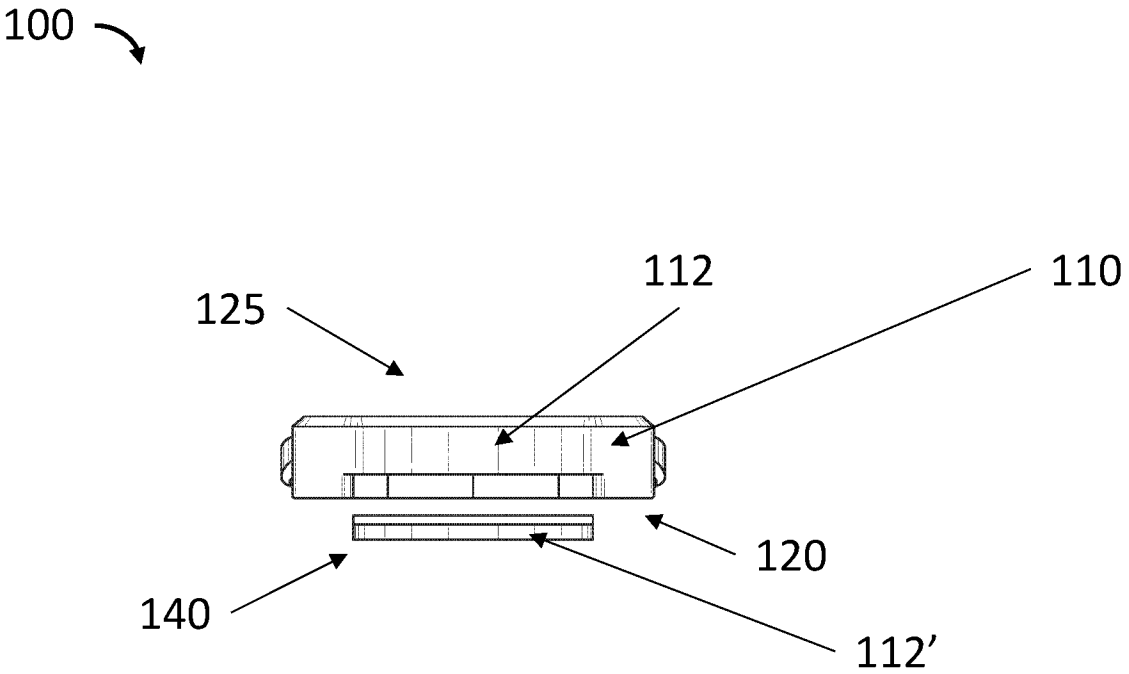
FIG. 13 depicts a second proximal end view of a preferred embodiments of the invention.
Figure 14:
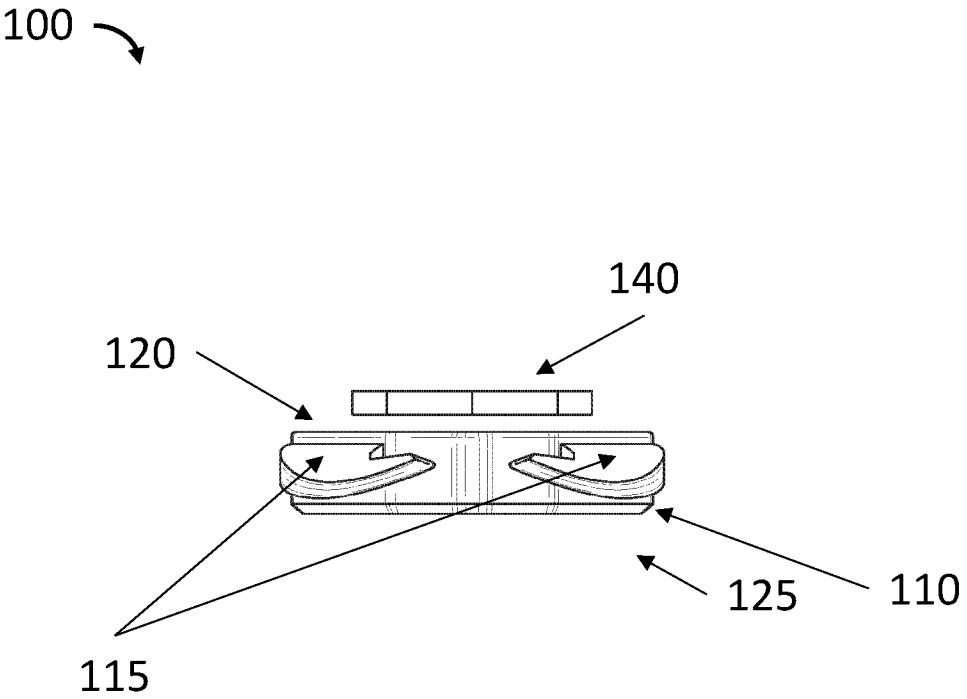
FIG. 14 depicts a second distal end view of a preferred embodiments of the invention.

FIGS. 1-14 illustrate one preferred embodiment of the instant invention 100 configured as a housing 110; including a V-shaped point and a pair of elongated generally parallel legs 115 extending from one peripheral edge of the housing 110 wherein the legs extend distally beyond the V-shaped point. As with known golf green tools, the legs 115 of the housing 110 may be utilized to lift up grass that has been depressed on a golf green and/or otherwise in the replacement of divots.

It is contemplated that the tips of the legs 115 may be utilized to clean out golf head grooves, and other similar needed tasks related to the game of golf.

In certain embodiments the legs 115 are each tapered to a point and are sharp so as to allow to clean golf head grooves.

In certain embodiments, there is a space between the legs and also a bore which allows for the legs to have sufficient space to be inserted into the ground. In certain embodiments, the legs 115 have a smaller length than the body 110.

In certain embodiments, the inner edges of the legs 115 are sharp to allow for cleaning of club head grooves.

The housing 110 includes a semi-circular cutout 112 which when the housing 110 is placed on the ground and the semi-circular cutout edge 112 is abutted against a ball; the housing 110 may serve as a first ball marker.

The housing 110 has an obverse surface 120 and a reverse surface 125. The obverse surface 120 has an annular rim 130 therein which defines a shallow concave tray or recess that serves as a seat or holder 135 for a detachable second ball marker 140.

The ball marker seat 135 is of an elongated configuration and at one end is configured with a semi-circular cutout 112 which when abutted against a golf ball functions as a first ball marker as described above.

The detachable second ball marker 140 is of an elongated configuration and at one end is configured with a semi-circular edge 112' corresponding to and with the recessed seat or holder 135 which when the second ball marker is detached and removed from the housing 110 and abutted against a golf ball functions as a second ball marker 140.

It is contemplated that the detachable second ball marker 140 comprise a magnetic flux density field conductive material and that the housing 110 comprise an integrated magnet 145 which detachable affixes the second ball marker 140 to the housing 110 for storage.

It is also contemplated that the integrated magnet 145 be of sufficient magnetic flux density to hold the housing 110 including the detachable second ball marker 140 to a magnetic flux density field conductive surface such as a golf club, a golf cart surface, and the like; for storage and quick retrieval when needed.

In certain embodiments, arrows on the device are used as an alignment aid to assist a golfer to line up a putt.

In certain embodiments, the device has a logo.

In certain embodiments, the bottom of the device is cutout to allow for placement on the ground.

In certain embodiments, the divot tool fits into a pocket of a golfer.

In certain embodiments, the divot tool is configured to attached to a metal post of a golf cart.

It is contemplated in a preferred embodiment of the instant invention 100, the magnet 145 is encased or enclosed in a plastic or silicone rubber housing (Not Shown) wherein the plastic or silicone rubber housing protects the magnet 145 from physical and electromagnetic deterioration.

Having thus described the invention; its advantages and objectives can be easily understood. Variations from the description above may and can be made by one skilled in the art without departing from the scope of the invention.

Accordingly, this invention is not to be limited by the embodiments as described, which are given by way of example only and not by way of limitation.

The invention claimed is:

1. A portable magnetic multifunctional golf accessory configured to be used as a golf green repairer, a club face groove cleaner, an object rest, a first ball marker, and a detachable second ball marker, the portable magnetic multifunctional golf accessory comprising:

a housing with an upper face, a lower face, a proximal end, and a distal end, the distal end of the housing forming the golf green repairer and the opposing proximal end of the housing forming the object rest and first ball marker;

the golf green repairer comprising a V-shaped point and two tapered legs extending distally beyond the V-shaped point, wherein each of the tapered legs has a distal end that ends in a sharp point, wherein the upper surface of each of the two tapered legs have sharp inner edges, wherein the golf green repairer is configured to facilitate golf green repair of a divot, the distal ends of the two tapered legs allow the golf green repairer to be inserted into the ground to facilitate the repair of the divot;

wherein the two tapered legs distal ends are configured to clean out the grooves of a golf club head, wherein the sharp inner edges are configured to fit within the grooves of the club head;

the housing upper face includes a cavity disposed therein in which a detachable second ball marker is stored and detachably secured within the housing cavity via a magnet integrated into the housing and below the housing cavity;

the housing is adapted to be placed lower face down on a golf green and function as a ball marker via a semi-circular cut-out at the proximal end of the housing being abutted against a ball to be marked;

the housing is adapted to be anchored in the ground via the two tapered legs and when disposed in an upright position with the proximal end of the housing upward such that the semi- circular cut-out at the proximal end of the housing functions as an object rest;

wherein an object may be placed and rest within the semi-circular cut-out at the upwardly pointed proximal end of the housing such that the object is propped off the ground and a tendency for the object to roll away because of unlevel ground placement of the housing is inhibited, wherein the detachable second ball marker includes indicia to aide in ball replacement and alignment.

2. The golf accessory of claim 1, wherein the housing made from a group consisting of a natural material, a synthetic material, a metal, a plastic or polymer, or a combination thereof.

3. The golf accessory of claim 1, wherein the housing comprises a nonmagnetic flux density field conductive material.

4. The golf accessory of claim 1, wherein the housing includes indicia to aide in ball replacement and alignment.

5. The golf accessory of claim 1, wherein the detachable second ball marker comprises a magnetic flux density field conductive material.

6. The golf accessory of claim 1, wherein the magnet is a permanent magnet configured as a disc with each flat side being an opposite magnetic polarity.

7. The golf accessory of claim 1, wherein the magnet is encased in a protective barrier to mitigate physical and electromagnetic deterioration.

8. The golf accessory of claim 1, wherein the magnet is of sufficient magnetic flux field density to detachably affix the golf accessory to a magnetic flux field conductive surface.

9. The golf accessory of claim 1, wherein the two tapered legs have a smaller length than the housing.

10. The golf accessory of claim 1, wherein the detachable second ball marker includes a semi-circular cut-out at its proximal end.

11. The golf accessory of claim 1, wherein the golf accessory is configured to fit within the pocket of a user.

12. A portable magnetic multifunctional golf accessory configured to be used as a golf green repairer, a club face groove cleaner, an object rest, a first ball marker, and a detachable second ball marker, the portable magnetic multifunctional golf accessory consisting:

a housing with an upper face, a lower face, a proximal end, and a distal end, the distal end of the housing forming the golf green repairer and the opposing proximal end of the housing forming the object rest and first ball marker;

the golf green repairer comprising a V-shaped point and two tapered legs extending distally beyond the V-shaped point, wherein each of the tapered legs has a distal end that ends in a sharp point, wherein the upper surface of each of the two tapered legs have sharp inner edges, wherein the golf green repairer is configured to facilitate golf green repair of a divot, the distal ends of the two tapered legs allow the golf green repairer to be inserted into the ground to facilitate the repair of the divot;

wherein the two tapered legs distal ends are configured to clean out the grooves of a golf club head, wherein the sharp inner edges are configured to fit within the grooves of the club head;

the housing upper face includes a cavity disposed therein in which a detachable second ball marker is stored and detachably secured within the housing cavity via a magnet integrated into the housing and below the housing cavity;

the housing is adapted to be placed lower face down on a golf green and function as a ball marker via a semi-circular cut-out at the proximal end of the housing being abutted against a ball to be marked;

the housing is adapted to be anchored in the ground via the two tapered legs and when disposed in an upright position with the proximal end of the housing upward such that the semi- circular cut-out at the proximal end of the housing functions as an object rest;

wherein an object may be placed and rest within the semi-circular cut-out at the upwardly pointed proximal end of the housing such that the object is propped off the ground and a tendency for the object to roll away because of unlevel ground placement of the housing is inhibited, wherein the detachable second ball marker includes indicia to aide in ball replacement and alignment.

* * * * *